United States Patent [19]

Andro et al.

[11] Patent Number: 4,735,263

[45] Date of Patent: Apr. 5, 1988

[54] FLOW CONTROL DEVICE FOR HEAT EXCHANGER TUBE

[75] Inventors: Jean Andro, La Celle Saint Cloud; Jacques Marjollet, Paris; Francois Carpentier, Clamart, all of France

[73] Assignee: Stein Industrie, Velizy-Villacoublay, France

[21] Appl. No.: 945,705

[22] Filed: Dec. 23, 1986

[30] Foreign Application Priority Data

Dec. 23, 1985 [FR] France ..... 85 19042

[51] Int. Cl.[4] ..... F28B 1/00

[52] U.S. Cl. ..... 165/134.1; 165/174; 122/406 B

[58] Field of Search ..... 165/174, 134.1, 174; 122/402 B; 138/38

[56] References Cited

U.S. PATENT DOCUMENTS

| | | | |
|---|---|---|---|
| 2,143,477 | 1/1939 | Dillon et al. | 165/174 X |
| 3,568,764 | 3/1971 | Neuman et al. | 165/134.1 |
| 3,707,186 | 12/1972 | Zorrilla et al. | 165/134.1 |
| 3,977,068 | 8/1976 | Krips | 138/40 |
| 3,983,903 | 10/1976 | Kuehn, Jr. | 29/157.4 |
| 4,160,560 | 8/1978 | Lauro | 165/174 X |
| 4,191,246 | 3/1980 | Cassel | 165/134.1 |
| 4,670,689 | 8/1986 | Mochida et al. | 165/174 X |

FOREIGN PATENT DOCUMENTS

| | | | |
|---|---|---|---|
| 0028809 | 5/1981 | European Pat. Off. | 165/174 |
| 2431650 | 2/1980 | France | 165/174 |
| 663956 | 1/1952 | United Kingdom | 165/174 |
| 1507833 | 4/1978 | United Kingdom | 165/174 |
| 2034618 | 6/1980 | United Kingdom | 165/174 |
| 2082308 | 3/1982 | United Kingdom | 165/174 |

*Primary Examiner*—Albert W. Davis, Jr.
*Assistant Examiner*—Peggy Neils
*Attorney, Agent, or Firm*—Sughrue, Mion, Zinn, Macpeak & Seas

[57] ABSTRACT

The flow control device for a steam circulating heat exchanger tube (2) comprises an insert (4), secured in the tube by expansion in a zone (9) near the end of the exchanger tube or of the tube sheet (1) orifice provided in lieu of said tube, and an orifice plate (7) made from an erosion-corrosion resistant metal and secured inside the insert upstream from the bulged zone (9) created by expansion, from the standpoint of fluid flow, said insert extending for a considerable length downstream from the orifice plate. The insert includes an upstream tubular member (5) made from a metal having a low yield strength but a high elastic elongation ratio and a downstream tubular member (6) made from a metal resistant to erosion-corrosion and at least as long as ten times its inside diameter, ending in a bevel (12) tapering outwardly at an angle of less than 15°.

15 Claims, 3 Drawing Sheets

D
L ≥ 10D
V
1
2
3
4
5
6
7
8
9
10
11
12
13
14
15

FLOW CONTROL DEVICE FOR HEAT EXCHANGER TUBE

This invention concerns a device for controlling the flow of steam in a heat exchanger tube, said device comprising an insert secured by expansion in a zone of the end of the exchanger tube or of the orifice in the tube sheet corresponding to such tube, and an orifice plate made of an erosion-corrosion resistant metal, secured inside the insert, downstream from the expanded or bulged zone, from the standpoint of the direction of fluid flow, said insert extending a considerable length downstream from the orifice plate.

BACKGROUND OF THE INVENTION

Such flow control devices serve in particular to control the distribution of flow between the tubes of a tube bank in a heat exchanger, when one wishes to cause less flow in some tubes than in others, the amount of heat transferred through the first tubes intended to be less than through the other tubes according to the flowrate or temperature of the fluid impinging on the outside surface of the tubes. This case occurs in particular in heat exchangers in which highly pressurized heating steam flows through a tube bank in several successive passes, exchanging heat with firstly a relativey cold fluid, then a partly heated fluid.

The metal of the insert must exhibit specific characteristics enabling easy expansion in the tube of a bank or in the hole of the tube sheet corresponding to this tube, and must have a coefficient of expansion approximating that of the exchanger tube in order to avoid debulging from the effect of temperature cycling. It must also be able to substantially withstand erosion-corrosion from saturated steam leaving the orifice plate due to the high velocites attained in the orifice. Only very expensive alloys exhibit all of these properties combined.

It is the object of the present invention to provide a control device that is easy to secure within the heat exchanger tube or the corresponding orifice of a tube sheet by expansion, which also exhibits an outstanding resistance to erosion-corrosion from the steam which must flow therethrough.

SUMMARY OF THE INVENTION

The insert of the device according to the invention comprises an upstream tubular member made of a metal having a low yield strength but a high elastic elongation ratio, and a downstream tubular member made of a metal resistant to erosion and corrosion, being at least as long as 10 times its inside diameter, and ending in a bevel tapering outwardly at an angle of less than 15°.

The inventive device furthermore preferably includes at least one of the following features:

The upstream and downstream members of the insert and the outside periphery of the orifice plate are joined by at least one weld seam.

The upstream tubular member is welded by its extreme upstream edge to the inside periphery of the exchanger tube, or of the hole of the tube sheet, upstream from its bulged zone.

The upstream tubular member is welded by its extreme upstream edge to the weld between the tube and the tube sheet, on the latter's upstream face.

The orifice plate is crimpingly secured in the upstream and downstream tubular members of the insert.

DESCRIPTION OF THE DRAWINGS

Several embodiments of flow control devices according to the invention for inclusion in the tubes of a bank of heating steam tubes being part of a saturated steam separator-superheater will now be described by way of example only, with reference to the accompanying drawings in which.

DESCRIPTION OF THE PREFERRED EMBODIMENTS

Figures 1, 2, 3:
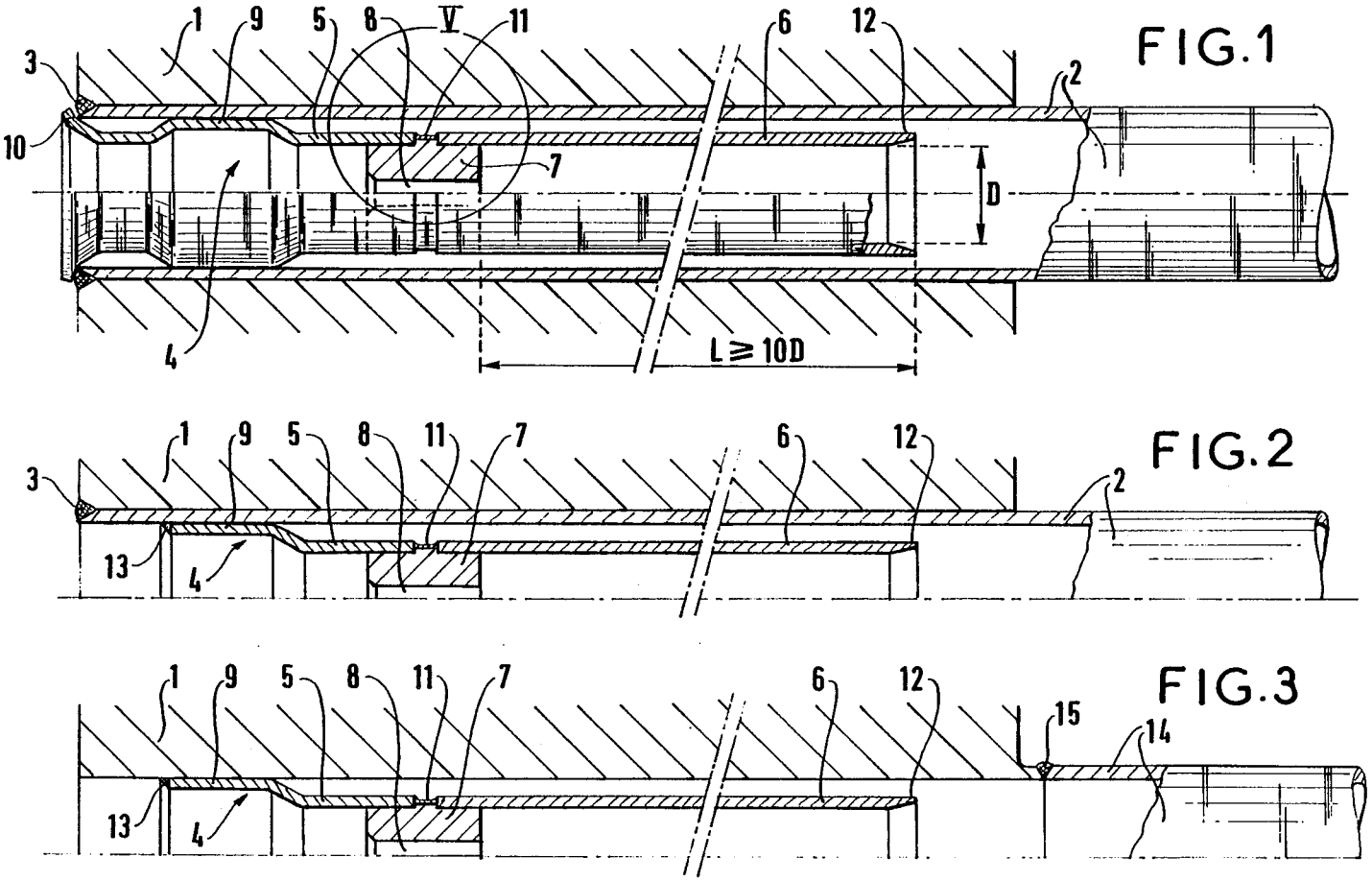
FIG. 1 is an axial sectional view of a device in which the upstream and downstream tubular members of the insert and the orifice plate are joined by a single weld bead.
FIG. 2 is an axial sectional view of a device analogous to that shown in FIG. 1, except that the usptream end of the insert is attached in the tube by a weld bead.
FIG. 3 is an axial sectional view of a device analogous to that shown in FIG. 1, except that the insert is attached by expansion in a hole in the tube sheet.

In the embodiment shown in FIG. 1, the end of the heat exchanger tube 2 is attached in an orifice of the tube sheet 1 and its distal rim is welded to said tube sheet at 3. The flow control device 4 consists of an upstream part 5 and a downstrem part 6, welded to each other and to the orifice plate 7, containing a calibrated bore 8. The usptream part or member is made from a steel having a low yield strength but high elastic elongation ratio, being for example carbon steel of grade Tu 42.

The latter member's upstream portion 9 is expanded in the end of the heat exchanger tube such as to provide a fluid-tight seal between the control device and the tube. Its distal end 10 is bent back over the end of same tube.

The downstream member of the flow control device is made from a steel resistant to erosion-corrosion from steam, for example one of the steels known under the designations Z2 CN 18-10 or Z2 CT 18.

The wall of the downstream member is slightly thinner than that of the upstream member. The length of the downstream member is greater than at least 10 inside diameters thereof, to prevent erosion-corrosion phenomena from appearing on the inside wall of the tube due to the outflow of steam from the orifice of the orifice plate, as a result of the pressure drop in the steam on passing through the orifice plate, and this member ends in a bevel 12 tapering out at an angle of less than 15°, bringing about a laminar flow in contact with the tube wall.

Figure 5:
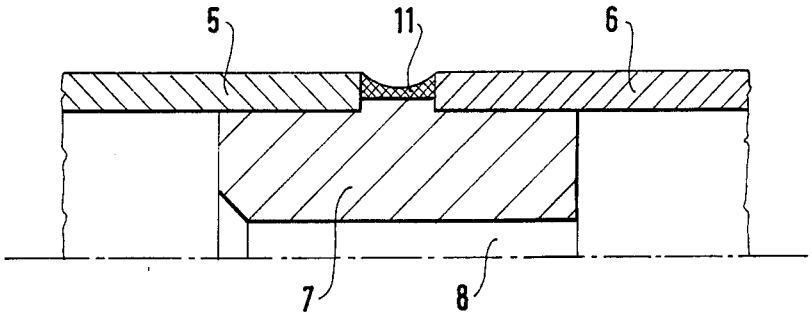
FIG. 5 shows the detail V of FIG. 1 drawn to a larger scale.

The orifice plate 7 with calibrated orifice 8 is also made from a steel resistant to steam erosion-corrosion, for example Z2 CN 18-10 steel. The upstream and downstream members and the orifice plate are welded together by a weld 11, drawn to a larger scale in FIG. 5, in which it can be seen that the facing ends of the upstream and downstream members abut a circumferential shoulder on the orifice plate 7.

FIG. 2 illustrates a device analogous to that shown in FIG. 1, the distal end of the upstream member whereof however is attached to the internal circumference of the tube by a weld 13, such as to prevent the flow control device sliding within the tube in the event of a failure of the bulged or expanded fit in zone 9.

FIG. 3 illustrates a device analogous to that shown in FIG. 1, except that the tube 14 is not inserted into the tube sheet 1, but is instead welded to the downstream face thereof by means of a bead 15. In this embodiment, the flow control device itself is expandedly fitted to the inside of the tube sheet in its zone 9 and its distal end is welded to the tube sheet by weld bead 13.

Figure 4:
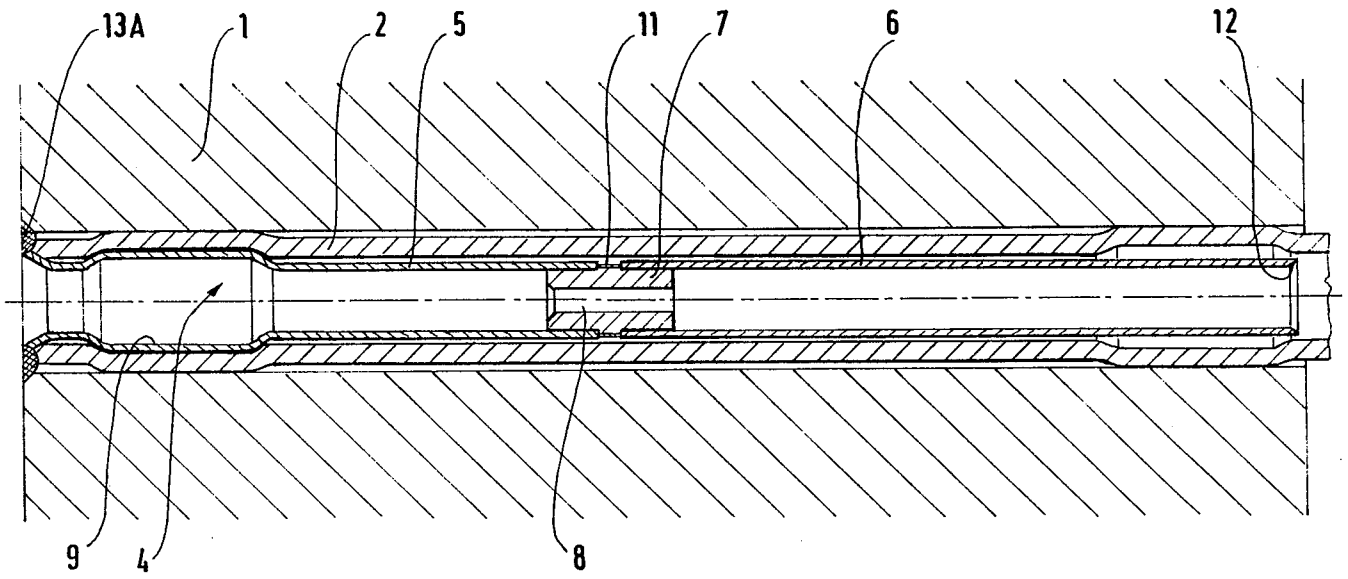
FIG. 4 is an axial sectional view of a device analogous to that shown in FIG. 1, except that the upstream end of the insert is welded to the weld seam between the tube and the tube sheet, on the upstream face of the tube sheet.

FIG. 4 illustrates a device analogous to that shown in FIG. 1, except that the upstream rim of the insert is welded to the weld bead joining the end of the tube to the tube sheet, thus producing a common weld bead 13A. This approach provides a much better access for welding the end of the insert and accordingly makes it easier to weld and easier to inspect the weld.

Figure 6:
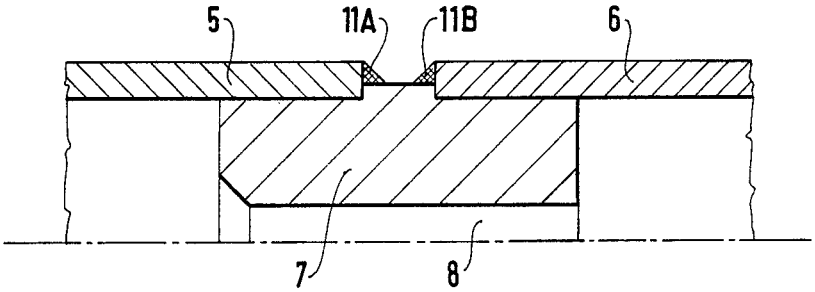
FIG. 6 is an enlarged view of an alternative embodiment of the detail V of FIG. 1, in which the the upstream and downstream tubular members of the insert are joined by two distinct weld beads to the orifice plate.

The enlarged detail of FIG. 6 represents a variant of the mutual fastening of the upstream and downstream members 5 and 6 and the orifice plate flow control device 7 by means of a weld bead 11A joining the upstream member to the orifice plate 7 and a weld bead 11B joining the downstream member to the same orifice plate.

Figure 7:
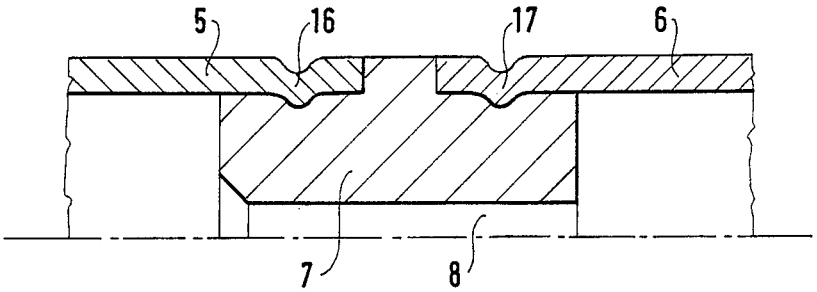
FIG. 7 is an enlarged view of another alternative embodiment of the detail IV of FIG. 1, in which the upstream and downstream tubular members of the insert are joined by crimping to the orifice plate.

FIG. 7 diagrams another variant of the mutual fastening of the upstream and downstream members and the orifice plate, in which the ends of the two members are crimped onto the plate 7 at 16 and 17 respectively.

What is claimed is:

1. In a device for controlling the flow of steam into a heat exchanger tube having an upstream, steam inlet end, said device comprising an insert including an expanded bulge zone expansion secured within the upstream end of the exchanger tube, and an orifice plate made of an erosion-corrosion resistant metal, secured inside the insert, downstream from the expanded bulge zone of said insert, said insert extending a considerable length downstream from the orifice plate, the improvement wherein said insert consists of an upstream tubular member made from a first metal having a low yield strength but a high elastic elongation ratio and including said expanded bulge zone to facilitate securing of said insert expanded bulge zone to the upstream end of the exchanger tube by local radial expansion thereof, and a separate, downstream tubular member secured coaxially to said upstream tubular member and made from a second metal more resistant to erosion-corrosion by steam than said first metal, said downstream tubular member being of a length equal to at least 10 times its inside diameter and ending in a bevel tapering outwardly at an angle of less than 15°.

2. A device according to claim 1, wherein the upstream and downstream members of the insert are joined to the outside periphery of the orifice plate by at least one weld.

3. A device according to claim 2, wherein the upstream tubular member is welded by its distal upstream rim to the inside periphery of the exchanger tube, upstream from the bulged zone.

4. Device according to claim 1 or claim 2, wherein the upstream tubular member is welded by its distal upstream rim to the weld seam between the tube and the tube sheet, on the latter's upstream face.

5. Device according to claim 1, wherein the orifice plate is crimped inside the upstream and downstream tubular members of the insert.

6. A device according to claim 1, wherein said first metal is a carbon steel and said second metal is a stainless steel.

7. A device according to claim 6, wherein said carbon steel is a carbon steel of grade Tu 42.

8. A device according to claim 6, wherein said stainless steel is a member of the group consisting of Z2 CN 18-10 and Z2 CT 18 steels.

9. In a device for controlling the flow of steam into a heat exchanger tube having an upstream, steam inlet end, coupled to a tube sheet orifice, said device comprising an insert including an expanded bulged zone expansion secured with said tube sheet orifice, and an orifice plate made of an erosion-corrosion resistant metal, secured inside the insert, downstream from the expanded bulge zone of said insert, said insert extending a considerable length downstream from the orifice plate, the improvement wherein said insert consists of an upstream tubular member made from a first metal having a low yield strength but a high elastic elongation ratio and including said expanded bulge zone to facilitate securing of said insert to said tube sheet orifice at said expanded bulge zone by radial expansion thereof, and a separate, downstream tubular member secured coaxially to said upstream tubular member, made from a second metal more resistant to erosion-corrosion by steam than said first metal, being of a length equal to at least 10 times its inside diameter, and ending in a bevel tapering outwardly at an angle of less than 15°.

10. A device according to claim 9, wherein said first metal is a carbon steel and said second metal is a stainless steel.

11. A device according to claim 10, wherein said carbon steel is a carbon steel of grade Tu 42.

12. A device according to claim 10, wherein said stainless steel is a member of the group consisting of Z2 CN 18-10 and Z2 CT 18 steels.

13. A device according to claim 9, wherein the upstream and downstream members of the insert are joined to the outside periphery of the orifice plate by at least one weld.

14. A device according to claim 9, wherein the upstream tubular member is welded by a distal upstream rim to the inside periphery of the tube sheet orifice, upstream from its expanded bulge zone.

15. A device according to claim 9, wherein the orifice plate is crimped inside the upstream and downstream tubular members of the insert.

* * * * *